US005749249A

United States Patent [19]

Jung

[11] Patent Number: 5,749,249

[45] Date of Patent: May 12, 1998

[54] WASHING MACHINE

[75] Inventor: Sung-Chil Jung, Kwangju City, Rep. of Korea

[73] Assignee: Daewoo Electronics Co., Ltd., Seoul, Rep. of Korea

[21] Appl. No.: 667,802

[22] Filed: Jun. 20, 1996

[30] Foreign Application Priority Data

Jun. 23, 1995 [KR] Rep. of Korea ..... 95-17114

[51] Int. Cl.[6] ..... D06F 37/18

[52] U.S. Cl. ..... 68/15; 68/196; 220/211

[58] Field of Search ..... 68/15, 16, 196; 134/105; 220/211, 203.04, 203.05

[56] References Cited

U.S. PATENT DOCUMENTS 2,258,215 10/1941 Paulson et al. ..... 134/105

3,503,085 3/1970 Groebli ..... 68/15 X 5,293,761 3/1994 Jang ..... 68/196 X

FOREIGN PATENT DOCUMENTS 933332 9/1955 Germany ..... 68/196

*Primary Examiner*—Philip R. Coe

*Attorney, Agent, or Firm*—Beveridge, DeGrandi, Weilacher & Young, LLP

[57] ABSTRACT

A washing machine includes a pressurized sealing arrangement capable of pressurizing and heating the interior of an outer tub which retains washing water by a pressure higher than the atmospheric pressure. Here, a heater is installed between the outer tub, and an inner tub and a piston and a driving unit of the piston are formed to the inner bottom plane of a top cover. The driving unit includes a screw shaft formed with a male screw along the outer circumference thereof, a series of gears for transmitting a rotational force to the screw shaft and a control motor.

7 Claims, 3 Drawing Sheets

WASHING MACHINE

BACKGROUND OF THE INVENTION

1. Field of the Invention

The present invention relates to a washing machine having a heater for heating the laundry and washing water within an outer tub, and more particularly to a washing machine having a pressurizing sealing arrangement to an outer tub for increasing a thermal capacity of washing water.

2. Description of the Prior Art

In washing machines of a variety of kinds, a vortex type washing machine which utilizes a pulsator has been generally employed as a household washing machine. In recent years, a full automatic washing machine with a single tub in which washing and dehydrating operations are performed in the same tub has been widely available. However, such a full automatic washing machine has a drawback of failing in affording a satisfactory washing effect since the washing is executed only by a cleansing force using a detergent and a mechanically frictional force applied by waterstream.

To solve the above problem, the washing tub is formed of a metal such as a stainless steel and, then, a heating unit such as a heater is installed to the interior of the outer tub to heat the washing water during the washing operation. By doing so, sterilizing action and solubility of the detergent are enhanced to improve an overall washing performance of the washing machine which commercially prevail in the market.

FIG. 1 is a schematic section view showing a single-tub washing machine installed with a heater among typical vortex type washing machines. Hereinbelow, a structure of the single-tub washing machine mounted with the heater will be described in detail with reference to FIG. 1.

As shown in FIG. 1, a side plane of the washing machine is enclosed by an out-case 3 and a top cover 1 is assembled to the upper end of out-case 3. A door 11 for putting in/out the laundry and a control panel (not shown) are provided to top cover 1.

In the interior of out-case 3, an outer tub 4 for retaining washing water suspends to out-case 3 by means of a plurality of rods 15 and dampers 17. A motor 7 for producing a rotational force required for the washing operation is attached to one side of an outer bottom plane of outer tub 4. Also, a shaft assembly 10 is installed to the center of the outer bottom plane of outer tub 4. Shafts of motor 7 and shaft assembly 10 are respectively inserted with pulleys to transmit a motive power by means of a belt 9.

Shaft assembly 10 is provided with a deceleration gear (not shown) and a clutch (not shown) for transmitting the rotational force supplied from motor 7 solely to a pulsator 13 or to both pulsator 13 and an inner tub 5 during the dehydrating course, under the control of a microcomputer (not shown).

Inner tub 5 for retaining the laundry is installed within outer tub 4 to be connected to shaft assembly 10, and the outer plane of inner tub 5 is formed with a plurality of holes to allow the washing water to agitate between outer tub 4 and inner tub 5. Pulsator 13 fitted with shaft assembly 10 is installed to the bottom plane of inner tub 5. Pulsator 13 has a diameter slightly smaller than that of the bottom of inner tub 5, which is formed with a plurality of projections serving for bringing about waterstream during the washing operation.

A coil-like heater 19 is installed around inner tub 5 between outer tub 4 and inner tub 5 while maintaining a prescribed distance from inner tub 5.

An operation of the washing machine constructed as above will be described below.

When the washing machine is operated after opening door 11 to get the laundry into the inner tub 5, the washing procedure is carried out in accordance with sequential washing courses programmed by the microcomputer. First, in a washing course, motor 7 repeats forward and backward rotation at a constant velocity, and a resulting rotational force is transmitted to shaft assembly 10 via belt 9. At this time, shaft assembly 10 rotates pulsator 13 in forward and backward directions via speed change of gear drive.

The washing water held within outer tub 4 and inner tub 5 forms the waterstream within inner tub 5 in accordance with the rotation of outer tub 5 and pulsator 13, and passes through the holes in inner tub 5 to upwardly float via a flow passage between outer tub 4 and inner tub 5 by means of a centrifugal force. The upwardly-floated washing water drops down as a waterfall from the upper portion of inner tub 5 to be circulated.

Once heater 19 dipped into the washing water is operated while the washing water is circulated, thermal transmission is carried out directly to the washing water. Then, the washing water having the raised temperature is distributed throughout the entire portion of inner tub 5 through the circulation with the consequence of raising the temperature of the washing water, the laundry and the detergent within outer tub 4.

According to the conventional single-tub washing machine mounted with the heater among the vortex washing machines, the enhanced washing effect can be anticipated by the heating, but the quantity of washing water and the laundry should be heated. In addition, the water vapor of high temperature is continuously drawn out of the washing machine by vaporization to significantly dissipate an electric energy.

SUMMARY OF THE INVENTION

The present invention is devised to solve the above-described problems. Accordingly, it is an object of the present invention to provide a washing machine having a pressurized sealing arrangement capable of pressurizing by a pressure higher than an atmospheric pressure and heating the interior of an outer tub which retains washing water.

To achieve the above object of the present invention, a washing machine includes an outer tub containing the laundry and washing water therein, a heater for heating the laundry end washing water, and a sealing unit for sealing the interior of the outer tub.

Here, the sealing unit is formed by a cylinder frame connected to the upper portion of the outer tub by means of a hinge to be capable of swinging thereabout, and a packing may be further installed between the outer tub and cylinder frame for preventing leakage of water vapor generated from the washing water.

Preferably, the cylinder frame is installed with a pressurizing unit for raising an internal pressure of the outer tub. The pressurizing unit has a cylinder formed to the inner side of the cylinder frame, and a piston fitted with the cylinder to correspond to the shape of the cylinder for being able to feed up and down direction. Additionally, a driving unit for driving the piston is provided as one constituent of the pressurizing unit.

More preferably, the driving unit includes a screw shaft which has one end connected with the piston and the other end formed with a driven gear and is formed with a screw along the outer circumference thereof to penetrate through the cylinder frame via a screw-coupling. Also, a connecting gear has a tooth form along the outer circumference thereof to be brought into meshing engagement with the driven gear while feeding the screw shaft, and a driving gear is engaged with the connecting gear via the tooth form. A control motor actuates the driving gear.

It is preferable that the pressurizing unit is further installed with a depressing unit for decreasing the internal pressure of the outer tub. More specifically, the depressing unit is an air hole piercing through the cylinder frame and opened/closed by the motion of the piston, which is formed in the top dead center area of the piston.

Alternatively, to achieve the above object of the present invention, a washing machine includes an outer tub containing the laundry and washing water therein, and a heater for heating the laundry and washing water. A cylinder frame is connected to the upper portion of the outer tub by means of a hinge to be capable of swinging thereabout, and a packing is installed between the outer tub and cylinder frame for preventing leakage of water vapor generated from the washing water. A cylinder formed to the inner side of the cylinder frame is fitted with a piston formed to correspond to the shape of the cylinder for being able to feed in the up and down direction. Also, a screw shaft has one end connected with the piston and the other end formed with a driven gear, and is formed with a screw along the outer circumference thereof to penetrate through the cylinder frame, and a connecting gear has a tooth form along the outer circumference thereof to be brought into meshing engagement with the driven gear while feeding the screw shaft. Thus, a driving gear is engaged with the connecting gear via the tooth form and is actuated by a control gear. An air hole piercing through the cylinder frame is formed in the top dead center area of the piston, which is opened/closed by the motion of the piston.

In operation, when the cylinder frame is closed after the laundry is put into the washing machine, a pulsator is rotated by the rotation of the motor to initiate the washing course. Once the washing course begins, the heater controlled by a microcomputer is operated to generate the heat. Also, the control motor is rotated to descend the piston. When the descending piston passes through the air hole, the interior of the outer tub is substantially compressed. Thus, water vapor produced from the washing water of high temperature fills up the tightly-closed space within the outer tub. That is, washing operation with respect to the laundry is carried out while the interior of the outer tub is in the high temperature and high pressure state.

After completing the washing course, the operation of the heater is stopped and the control motor is rotated counter-clockwise to ascend the piston. Once the ascending piston passes through the air hole, the internally-existing water vapor of high temperature and high pressure is released to the atmosphere to drop the internal pressure of the outer tub down to the atmospheric pressure level. Thereafter, the cylinder frame is to be open to get the laundry out of the washing machine or to conduct a dehydrating course.

In the washing machine according to the present invention constructed as above, the boiling point of the washing water is raised by pressurizing the interior of the outer tub, and the temperature of the washing water is heightened by the heating. Therefore, the washing machine according to the present invention is advantageous of improving the solubility of the detergent, enhancing the washing performance and economizing the electrical energy.

BRIEF DESCRIPTION OF THE DRAWINGS

The above objects and other advantages of the present invention will become more apparent by describing in detail preferred embodiments thereof with reference to the attached drawings in which.

DETAILED DESCRIPTION OF THE PREFERRED EMBODIMENT

A washing machine according to the present invention will be described in detail with reference to accompanying drawings.

Figure 1:
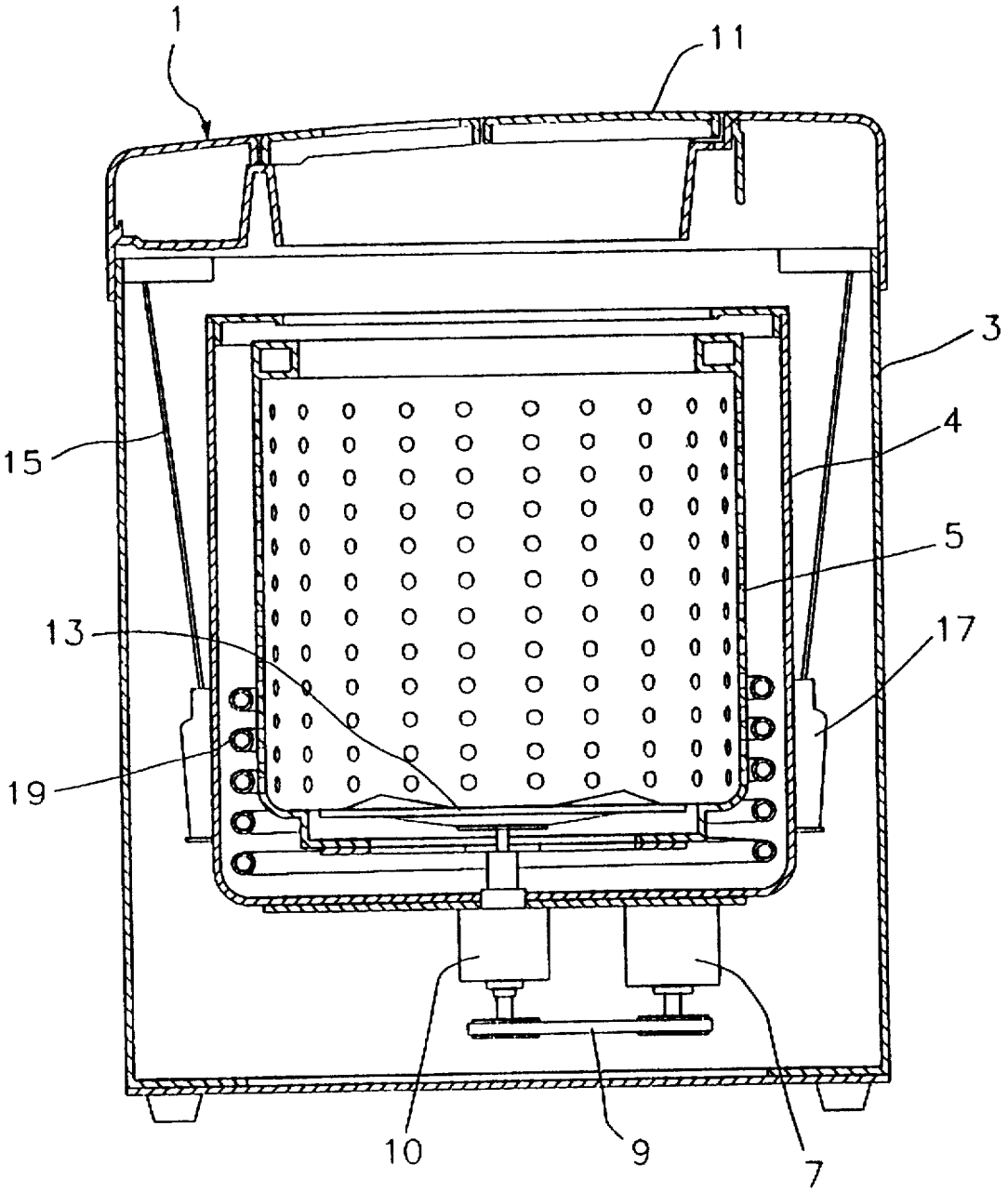
FIG. 1 PRIOR ART
FIG. 1 is a schematic section view showing a single-tub washing machine mounted with a heater among conventional vortex type washing machines.
Figure 2:
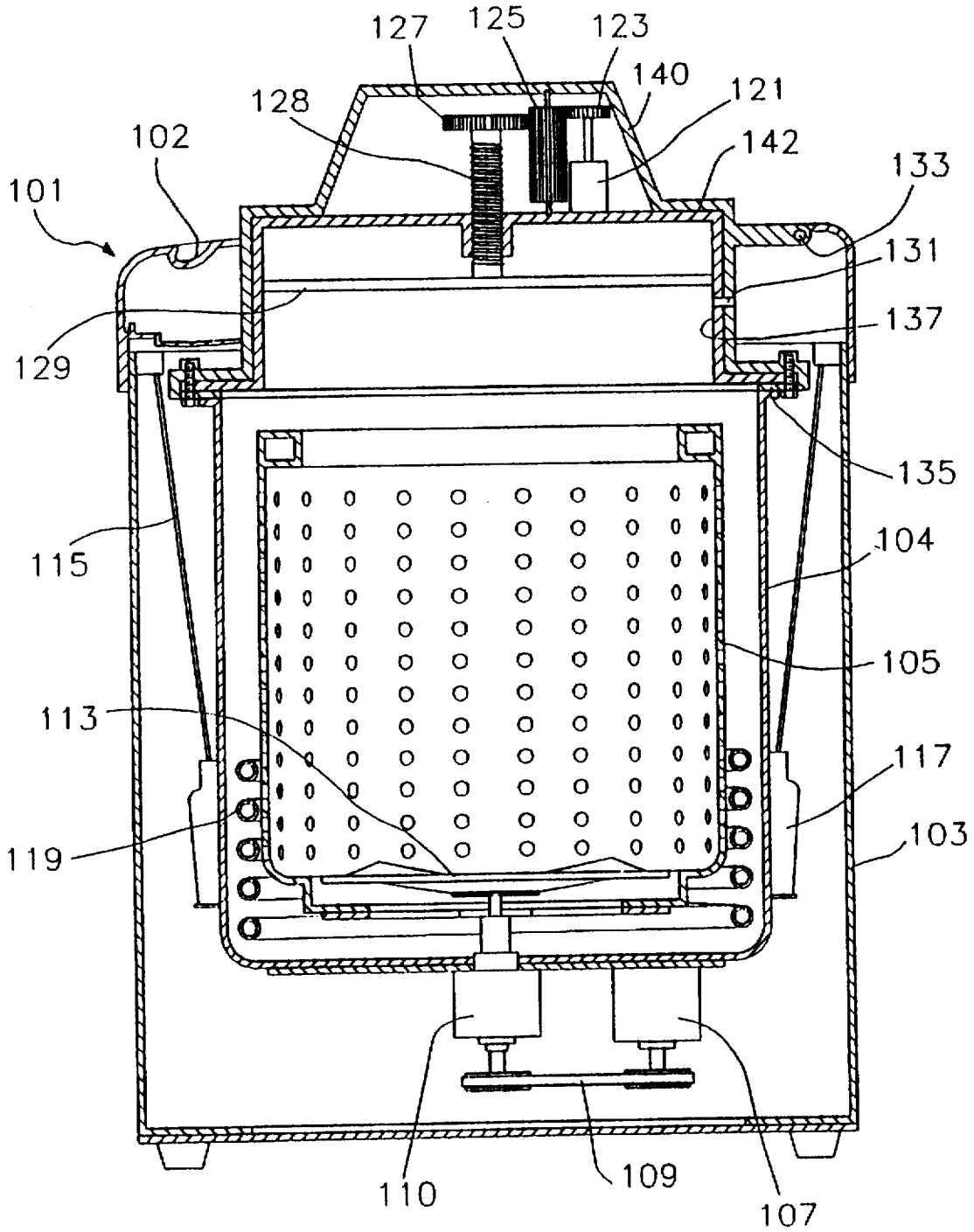
FIG. 2 is a schematic section view showing a state when a piston of a washing machine according to the present invention is placed on the top dead center.

FIG. 2 is a schematic section view showing a state when a piston of the washing machine according to the present invention is placed on the top dead center.

Referring to FIG. 2, a side plane of the washing machine is enclosed by an out-case 103, and a top cover 101 is assembled to the upper end of out-case 103 connected by a hinge 133 to be capable of swinging thereabout. Top cover 101 is provided with a knob 102 formed to be hollowed to permit a user to be easily opened and is installed with a control panel (not shown) of the washing machine.

In the interior of out-case 103, an outer tub 104 for retaining washing water suspends to out-case 103 by means of four rods 115. Dampers 117 for absorbing vibration generated during performing the washing operation are inserted to connecting portions of respective rods 115 and outer tub 104.

A motor 107 for producing a rotational force required for the washing is attached to a portion apart from the center of outer bottom plane of outer tub 104 by a predetermined distance in the radius direction. Also, a shaft assembly 110 is installed to the center of the outer bottom plane of outer tub 104. Shafts of motor 107 and shaft assembly 110 are respectively inserted with pulleys to transmit the power by means of a belt 9.

Shaft assembly 110 is provided with a deceleration gear (not shown) and a clutch (not shown) for transmitting the rotational force supplied from motor 107 solely to a pulsator 113 or to both pulsator 113 and an inner tub 105 during the dehydrating course, under the control of a microprocessor (not shown).

Outer tub 104 is provided with inner tub 105 for retaining the laundry, pulsator 113 for producing waterstream and a heater 119 for generating the heat therein. The center of the bottom plane of inner tub 105 is connected to shaft assembly 110, and the side portion of inner tub 105 is formed with a plurality of holes to allow the washing water to agitate between outer tub 104 and inner tub 105. The upper plane of inner tub 105 is open to serve as an entry and exit of the laundry.

Pulsator 113 fitted with shaft assembly 110 is installed to the bottom plane of inner tub 105. Pulsator 113 has a diameter slightly smaller than that of the bottom plane of inner tub 105, which is formed with a plurality of projections thereon serving for bringing about the waterstream during the washing operation.

Coil-like heater 119 is installed around inner tub 105 between outer tub 104 and inner tub 105 spaced apart from inner tub 105 by a prescribed distance.

An assembly of top cover 101 capable of swinging by hinge 133 and a cylinder frame 142 is installed to the upper portion of outer tub 104. Cylinder frame 142 is inwardly indented to form a cylinder 137, and tightly attached to the upper portion of outer tub 104. A packing 135 is inserted between outer tub 104 and cylinder frame 142 in the circumferential direction for preventing leakage of the water vapor. Packing 135 is formed of a substance having an elasticity, e.g., a rubber, which may be the same or similar to a typical gasket.

A piston 129 is fitted to the inside of cylinder 137 to correspond to the shape of cylinder 137, thereby being movable up and down. Cylinder 137 is formed with a female screw hole of a predetermined size in the center thereof. A screw shaft 128 is coupled into the female screw hole to transfer piston 129 up and down associative with the up and down transferring of screw shaft 128. In more detail, piston 129 is fixed to the end of screw shaft 128, and a male screw which can be driven into the female screw hole is processed to the outer circumference of screw shaft 128.

A driven gear 127 is attached to the upper end of screw shaft 128, and a connecting gear 125 is brought into meshing engagement between driven gear 127 and a driving gear 123. Connecting gear 125 is cylindrically shaped to be slightly longer than a feed distance of piston 129, and provided with tooth form along the circumference thereof for facilitating the meshing engagement even though driven gear 127 is transferred up and down. Driving gear 123 for transmitting the rotational force to connecting gear 125 is connected to a control motor 121 installed to the upper plane of cylinder frame 142.

Cylinder frame 142 and the piston driving system provided as above are covered with a fixing frame 140 not to be externally exposed, and a projection from a fixing frame 140 is connected by means of hinge 133.

When piston 129 is disposed on the top dead center, an air hole 131 penetrating through both cylinder frame 142 and fixing frame 140 is formed to the cylinder area spaced apart from piston 129 by a predetermined distance. Air hole 131 is opened/closed in conformity with the up and down positions of piston 129 to function for maintaining the pressure within outer tub 104 at the atmospheric pressure or sealing it from the atmospheric pressure.

Figure 3:
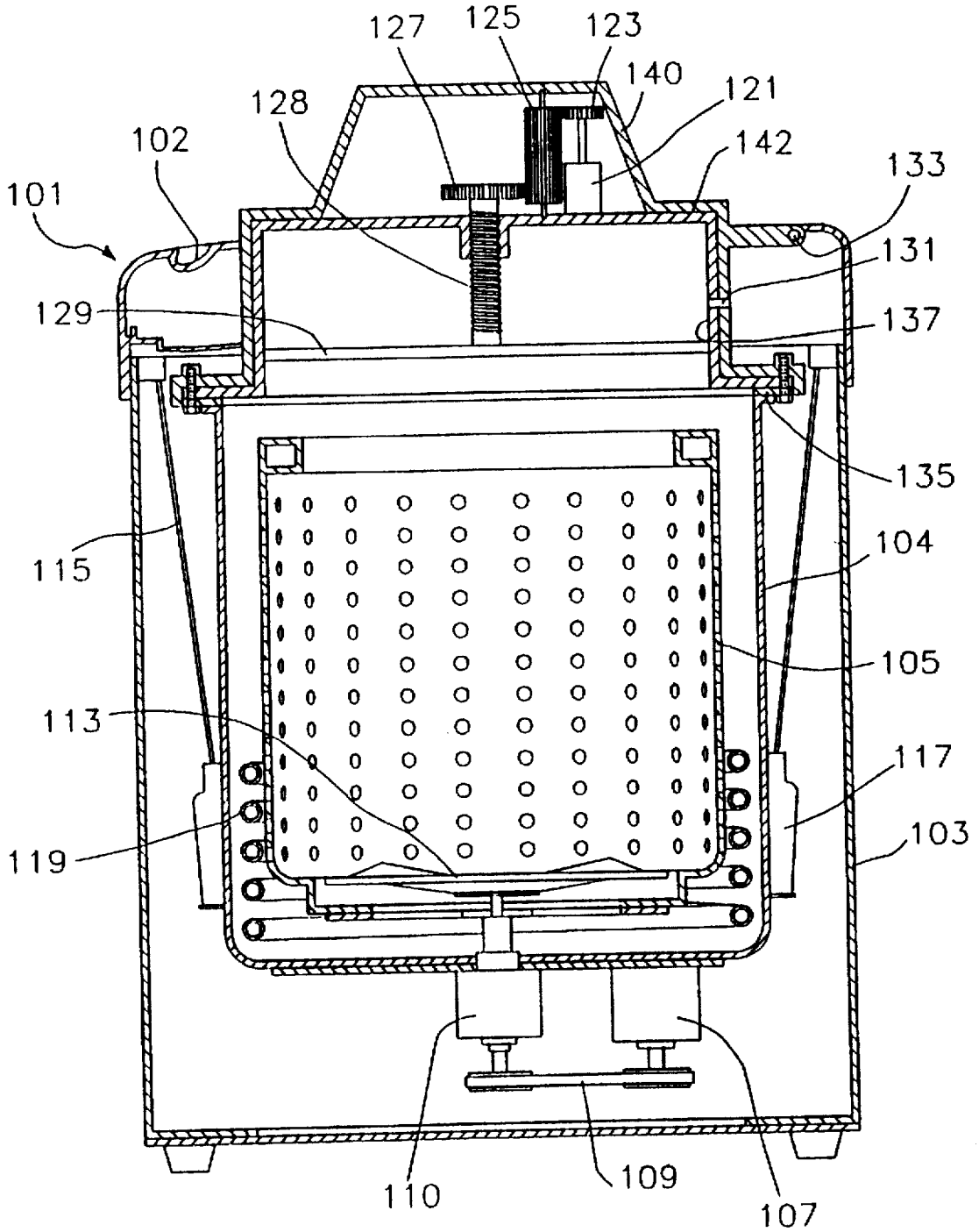
FIG. 3 is a schematic section view showing a state when the piston of FIG. 2 is placed on the bottom dead center.

FIG. 3 is a schematic section view showing the position of piston 129 and screw shaft 128 when piston 129 is placed to the bottom dead center.

The washing machine constructed as above is operated as below.

In order to carry out the washing, the user employs knob 102 to open top cover 101 of the washing machine. At this time, outer tub 104 and inner tub 105 are open while cylinder frame 142 integrally formed with top cover 101 and fixing frame 140 swing about hinge 133. After the user brings the predetermined laundry and detergent into inner tub 105 to close top cover 101, the washing stroke is initiated in order in view of the procedure pre-programmed in the microprocessor once a washing start button is pressed.

The washing stroke is executed as follows. To begin with, when the amount of the externally-admitted washing water reaches a prescribed level, heater 119 is connected to a power supply source for generating the heat to start thermal exchange with the washing water. Also, control motor 121 is rotated clockwise to rotate driving gear 123 and connecting gear 125. Together with the rotation of connecting gear 125, driven gear 127 is rotated.

At this time, screw shift 128 is rotated while transferred to be relatively downward with respect to cylinder frame 142 by the male screw formed to screw shaft 128. Along with the downward feeding of screw shaft 128, piston 129 directs downward to pass through air hole 131. While piston 129 passes through air hole 131, the interior of outer tub 104 and cylinder frame 142 is sealed from the atmospheric pressure and begins to be pressurized.

Due to this fact, the interior of outer tub 104 has a decreased volume by piston 129 under being sealed to not only be pressurized but also be in a state of high temperature and high pressure since no vapor pressure produced from the washing water is externally leaked.

Under this state, the rotation of motor 107 is transmitted to shaft assembly 110 via belt 109 and, in turn, rotates pulsator 113 clockwise and counter-clockwise, so that the waterstream is incited to perform the washing operation. It is apparent that the pressurized state has no deleterious influence upon the formation of the waterstream produced by the rotation of pulsator 113.

Upon the completion of the washing stroke, the laundry is taken out of the washing machine or the washing water is to be drained for performing the dehydration. At this time, if top cover 101 is abruptly opened or an exhaust valve (not shown) is opened, the user may be injured or burst of an explosive sound is made by the internal pressure of high pressure.

For preventing the serious situation, control motor 121 is rotated counter-clockwise to rotate screw shaft 128 counter-clockwise. The counter-clockwise rotation of screw shaft 128 ascends screw shaft 128, which is associated with the ascension of piston 129 to force piston 129 to place onto the top dead center after passing through air hole 131 from the bottom dead center. While piston 129 passes through air hole 131, the interior of outer tub 104 is gradually communicated with the atmospheric pressure. Consequently, the water vapor of high temperature and high pressure present in the interior of outer tub 104 is gradually leaked to the atmosphere, so that the internal pressure becomes identical to the atmospheric pressure. Under the state that the internal pressure is the same as the atmospheric pressure, the user opens top cover 101 to draw out the laundry or open the exhaust valve to initiate the dehydrating stroke.

In order to prevent lifting of top cover 101 and cylinder frame 142 caused by the internal pressure of outer tub 104 in the washing stroke, a locking device (not shown) may be installed between outer tub 104 and cylinder frame 142 or between out-case 103 and fixing frame 140.

The pressurizing sealing arrangement is installed to the inner bottom plane of top cover 101 in the washing machine according to the present invention, it can be applied to the conventional full automatic washing machine without causing any other modification. For this reason, the washing program of the microprocessor can be used unchanged except for rotation control of control motor 121. Also, such an operation upon control motor 121 is simply executed by the manual manipulation or a control signal of the microprocessor, which is obvious to the ordinary skilled in the art.

As a result, in the washing machine according to the present invention constructed as above, the boiling point of the washing water is raised by the high temperature and high pressure in the outer tub, and the temperature of the washing water is heightened. Thus, the solubility of the detergent is improved while enhancing the washing performance. Furthermore, the vaporization of water molecules of the washing water is suppressed to block a latent thermal loss during the vaporization. Furthermore, the heat applied by the heater remains in the washing water intact to lessen the thermal loss. Consequently, little thermal energy is enough to sufficiently heat the washing water to reduce the electric energy and increase the thermal efficiency.

While the present invention has been particularly shown and described with reference to particular embodiment thereof, it will be understood by those skilled in the art that various changes in form and details may be effected therein without departing from the spirit and scope of the invention as defined by the appended claims.

What is claimed is:

1. A washing machine comprising:

an outer tub containing the laundry and washing water therein;

a heater for heating said laundry and washing water; and a cylinder frame connected to the upper portion of said outer tub by means of a hinge to be capable of swinging thereabout, and installed with pressurizing means for raising an internal pressure of said outer tub;

wherein said pressurizing means comprises:

a cylinder formed to the inner side of said cylinder frame;

a piston fitted with said cylinder to correspond to the shape of said cylinder for being able to feed in the up and down direction; and driving means for driving said piston.

2. The washing machine as claimed in claim 1, further comprising a packing installed between said outer tub and cylinder frame for preventing leakage of water vapor generated from said washing water.

3. The washing machine as claimed in claim 1, wherein said driving means comprises:

a screw shaft having one end connected with said piston and the other end formed with a driven gear, and formed with a screw along the outer circumference thereof to penetrate through said cylinder frame via a screw-coupling;

a connecting gear having tooth form along the outer circumference thereof to be brought into meshing engagement with said driven gear while feeding said screw shaft;

a driving gear engaged with said connecting gear via said tooth form; and a control motor for actuating said driving gear.

4. The washing machine as claimed in claim 1, wherein said pressurizing means is further installed with depressing means for decreasing the internal pressure of said outer tub.

5. The washing machine as claimed in claim 4, wherein said depressing means is an air hole piercing through said cylinder frame and opened/closed by the motion of said piston.

6. The washing machine as claimed in claim 5, wherein said air hole is formed in the top dead center area of said piston.

7. A washing machine comprising:

an outer tub containing the laundry and washing water therein;

a heater for heating said laundry and washing water;

a cylinder frame connected to the upper portion of said outer tub by means of a hinge to be capable of swinging thereabout;

a packing installed between said outer tub and cylinder frame for preventing leakage of water vapor generated from said washing water;

a cylinder formed to the inner side of said cylinder frame;

a piston fitted with said cylinder to correspond to the shape of said cylinder for being able to feed in the up and clown direction;

a screw shaft having one end connected with said piston and the other end formed with a driven gear, and formed with a screw along the outer circumference thereof to penetrate through said cylinder frame;

a connecting gear having a tooth form along the outer circumference thereof to be brought into meshing engagement with said driven gear while feeding said screw shaft;

a driving gear engaged with said connecting gear via said tooth form;

a control motor for actuating said driving gear; and an air hole piercing through said cylinder frame to be formed in the top dead center area of said piston, and opened/closed by the motion of said piston.

* * * * *